United States Patent [19]

Ishikawa et al.

[11] Patent Number: 4,968,591

[45] **Date of Patent: * Nov. 6, 1990**

[54] PROCESSING FOR SILVER HALIDE COLOR PHOTOGRAPHIC MATERIALS

[75] Inventors: Takatoshi Ishikawa; Takeshi Hirose; Nobuo Furutachi, all of Kanagawa, Japan

[73] Assignee: Fuji Photo Film Co., Ltd., Kanagawa, Japan

[ * ] Notice: The portion of the term of this patent subsequent to Jul. 21, 2004 has been disclaimed.

[21] Appl. No.: 919,538

[22] Filed: Oct. 16, 1986

[30] Foreign Application Priority Data

Oct. 18, 1985 [JP] Japan ..... 60-231095

[51] Int. Cl.[5] ..... G03C 5/39; G03C 7/30

[52] U.S. Cl. ..... 430/372; 430/386; 430/387

[58] Field of Search ..... 430/551, 558, 372, 386, 430/387

[56] References Cited

U.S. PATENT DOCUMENTS

| | | | |
|---|---|---|---|
| 4,548,899 | 10/1985 | Nakayama et al. | 430/558 |
| 4,681,835 | 7/1987 | Ishikawa et al. | 430/372 X |
| 4,748,100 | 5/1988 | Umemoto et al. | 430/558 |
| 4,752,556 | 6/1988 | Kishimoto | 430/372 |
| 4,755,455 | 7/1988 | Iwasa | 430/558 |
| 4,762,773 | 8/1988 | Takahashi et al. | 430/558 |

FOREIGN PATENT DOCUMENTS

| | | | |
|---|---|---|---|
| 2132783 | 7/1984 | United Kingdom | 430/558 |

*Primary Examiner*—Paul R. Michl
*Assistant Examiner*—Lee C. Wright
*Attorney, Agent, or Firm*—Sughrue, Mion, Zinn, Macpeak & Seas

[57] ABSTRACT

A process for processing a silver halide color photographic material is described comprising subjecting a silver halide color photographic material comprising a support having provided thereon at least one photographic emulsion layer containing at least one kind of pyrazoloazole series magenta coupler represented by general formula (I) to photographic processing using a bath containing at least $1\times10^{-4}$ mol/liter of a soluble iron salt as the final bath:

(I)

wherein Za and Zb each represents =CH—, (wherein $R_2$ represents a hydrogen atom or a substituent) or =N—; $R_1$ represents a hydrogen atom or a substituent; X represents a hydrogen atom or a group releasably upon coupling with the oxidation product of an aromatic primary amine developing agent; when Za=Zb is a carbon-carbon double bond, the double bond may be a part of an aromatic ring; the magenta coupler may form a dimer or polymer at $R_1$, $R_2$ or X; when at least one of said Za and Zb is at least one of the $R_1$ and $R_2$ represents a methylene group directly bonded to the skeleton of general formula (I), at least one of the hydrogen atoms of which is substituted; when both Za and Zb are =N—, $R_1$ is a methylene group directly bonded to the skeleton, at least one of the hydrogen atoms of which is substituted; and the $R_1$ or $R_2$ has at least one —$NHSO_2$— as a substituent.

19 Claims, No Drawings

PROCESSING FOR SILVER HALIDE COLOR PHOTOGRAPHIC MATERIALS

FIELD OF THE INVENTION

This invention relates to a process for processing silver halide color photographic materials and, more particularly, to a process for processing silver halide color photographic materials capable of giving color images having very excellent image stability.

BACKGROUND OF THE INVENTION

In general, dye images obtained by processing silver halide color photographic materials are composed of azomethine dyes or indoaniline dyes formed by the reaction of couplers and the oxidation product of an aromatic primary amine developing agent. The dye images formed by such a mechanism are not always stable to light and heat to usually reduce the image quality by causing fading or discoloration of imaged portions or increasing of stain. In particular, in the case of color photographic papers, color prints are frequently stored in album, etc., or exhibited in general home and in this case the reduction in density of imaged portions and the increase of yellow stain give large problems.

For solving the above-described problems, various improvements have been proposed.

For example, there are proposed a technique of covering a dye image with an oxygen-intercepting layer composed of a material having a low oxygen permeability as described in Japanese Patent Application (OPI) Nos. 11330/74 and 57223/75 (the term "OPI" as used herein refers to a "published unexamined Japanese patent application") and also a technique of forming a layer having an oxygen permeability of less than 20 $ml/m^2 \cdot hr \cdot atm$ at the support side of dye image-forming layers of a color photographic material as described in Japanese Patent Application (OPI) No. 85747/81.

These techniques may have an effect to some extent for the prevention of the occurrence of yellow stain but they not only have no effect for cyan dye images but also accelerate the deterioration of cyan dye images as the case may be.

Also, a technique of employing a multilayer structure for surface protective layer is proposed in Japanese Patent Publication No. 8346/81 but a sufficient effect is not obtained by such a technique.

Also, various kinds of fading preventing agents have been developed. For example, there are the hydroquinone derivatives described in U.S. Pat. Nos. 2,360,290, 2,418,613, 2,675,314, 2,701,197, 2,704,713, 2,728,659, 2,732,300, 2,735,765, 2,710,801 and 2,816,028, British Patent No. 1,363,921, Japanese Patent Application (OPI) No 24141/83; the gallic acid derivatives described in U.S. Pat. Nos. 3,457,079, 3,069,262, etc.; the p-alkoxyphenols described in U.S. Pat. Nos. 2,735,765, 3,698,909, Japanese Patent Publication Nos. 20977/74, 6623/77, etc.; the p-oxyphenol derivatives described in U.S. Pat. Nos. 3,432,300, 3,573,050, 3,574,627, 3,764,337, Japanese Patent Application (OPI) Nos. 35633/77, 147434/77, 152225/77, etc.; the bisphenols described in U.S. Pat. No. 3,700,455, etc. However, the effect by these fading preventing agents is still insufficient.

On the other hand, some attempts have been applied for various processing steps for obtaining color images having excellent fastness. For example, as well known, a stabilization bath is employed as the final bath. The stabilization bath generally contains a pH adjusting agent, a surface active agent, an image stabilizer such as formalin, etc., a brightening agent, etc. However, such a stabilization bath does not have an effect for preventing fading of magenta images and also is frequently powerless for preventing the formation of yellow stain.

Also, a multistage countercurrent non-wash treatment is disclosed in Japanese Patent Application (OPI) No. 8543/82 and further as the technique for preventing the formation of yellow stain in the above treatment, the use of a chelating agent (e.g., Japanese Patent Application (OPI) No. 58143/82) and the addition of a water-soluble bismuth compound (e.g., Japanese Patent Application (OPI) No. 134636/83) have been proposed but the effect is insufficient.

Moreover, it is known to prevent fading of images by processing color photographic materials with a stabilization bath having a high concentration of iron salt as described in Japanese Patent Application (OPI) No. 14834/83. However, in this case, the prevention of the occurrence of yellow stain is insufficient and it is fastness are obtained.

As described above, it is very difficult to simultaneously attain the stability of color images, in particular, the light fastness of magenta dye images and the prevention of yellow stain in conventional techniques.

SUMMARY OF THE INVENTION

A first object of this invention is, therefore, to provide a process for processing silver halide color photographic materials capable of giving color images having very improved stability, in particular, light fastness of magenta dye images without the formation of yellow stain.

A second object of this invention is to provide a process for processing silver halide color photographic materials capable of greatly saving the amount of water for use.

It has now been discovered that the abovedescribed objects can be attained by subjecting a silver halide color photographic material comprising a support having provided thereon at least one photographic emulsion layer containing at least one kind of pyrazoloazole series magenta coupler represented by general formula (I) to photographic processing using a bath containing at least $1 \times 10^{-4}$ mol/liter of a soluble iron salt as the final bath for the photographic processing:

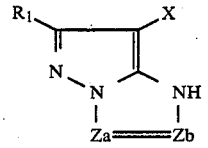

(I)

wherein Za and Zb each represents =CH—,

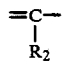

(wherein $R_2$ represents a hydrogen atom or a substituent) or =N—; $R_1$ represents a hydrogen atom or a substituent; and X represents a hydrogen atom or a group releasable upon coupling with the oxidation product of an aromatic primary amine developing agent. When Za=Zb is a carbon-carbon double bond, the double bond may form a part of an aromatic ring. Included are cases in which a dimer or polymer is formed at $R_1$, $R_2$ or X. When Za or Zb is

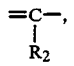

at least one of $R_1$ and $R_2$ represents a methylene group directly bonded to the skeleton of general formula (I), at least one of the hydrogen atoms of which is substituted; when both Za and Zb are =N—, $R_1$ represents a methylene group directly bonded to the skeleton, at least one of the hydrogen atoms of which is substituted; and $R_1$ or $R_2$ has at least one substituent —$NHSO_2$—. At least one of methylene groups directly bonded to the skeleton is preferably substituted by an alkyl group, more preferably substituted by an unsubstituted alkyl group of 1 to 4 carbon atoms.

DETAILED DESCRIPTION OF THE INVENTION

In this specification, the substituents such as an alkyl group, an alkyl residue, an aryl group, an aryl residue, etc., in general formula (I) described above and in general formulae (II) to (IV) described hereinbelow include the case that these substituents are further substituted.

In general formula (I) above, the term "a dimer or polymer" means the cases in which two or more moieties having general formula (I) occur in one molecule and, thus, includes a bis compound and a polymer coupler. The polymer coupler may be a homopolymer of monomer units having the moiety shown by general formula (I) above (preferably monomers containing vinyl groups, hereinafter, is referred to as "vinyl monomer") or may be a copolymer containing non-coloring ethylenic monomer units which does hot cause a coupling reaction with the oxidation product of an aromatic primary amine developing agent.

The magenta coupler represented by general formula (I) above can be also represented by the following general formula (I-1), (I-2), (I-3), (I-4) or (I-5):

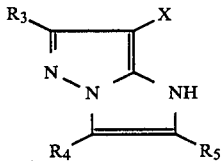

(I-1)

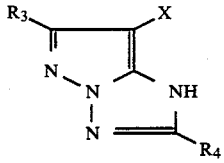

(I-2)

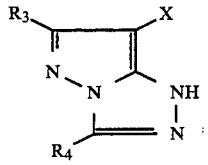

(I-3)

-continued

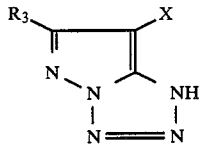

(I-4)

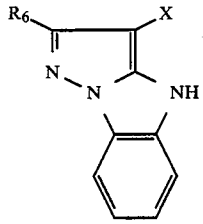

(I-5)

In the magenta couplers shown by general formulae (I-1) to (I-5) described above, preferred couplers for the objects of this invention are those shown by general formulae (I1), (I2) and (I-3) and further the coupler shown by general formula (I-2) is more preferred.

In general formulae (I-1) to (I-3), $R_3$, $R_4$ and $R_5$ each represents a hydrogen atom, a halogen atom, an alkyl group, an aryl group, a heterocyclic group, a cyano group, an alkoxy group, an aryloxy group, a heterocyclic cyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group; at least one of $R_3$, $R_4$ and $R_5$ represents a branched alkyl group at the position directly bonded to the skeleton.

In general formulae (I-4) and (I-5) described above, $R_6$ represents a branched alkyl group at the position directly bonded to the skeleton.

In general formulae (I-1) to (I-5) above, X represents a hydrogen atom, a halogen atom, a carboxy group or a coupling-off group attached to the carbon atom in the coupling position through an oxygen atom, a nitrogen atom or a sulfur atom.

The couplers shown by general formulae (I-1) to (I-5) include the case that $R_3$, $R_4$, $R_5$, $R_6$ or X may be a divalent group to form a bis compound. Also, when the moiety shown by general formulae (I-1) to (I-5) is in the vinyl monomer, $R_3$, $R_4$, $R_5$ or $R_6$ represents a simple bond or a linkage group, through which the moiety shown by general formulae (I-1) to (I-5) is bonded to a vinyl group.

Then, the above-described groups are described in more detail.

That is, $R_3$, $R_4$ and $R_5$ each represents a hydrogen atom, a halogen atom (e.g., a chlorine atom, a bromine atom, etc. an alkyl group (e.g., a methyl group, a propyl group, a hexyl group, a trifluoromethyl group, a tridecyl group, a 3-(2,4-di-t-amylphenoxy)propyl group, a 2-dodecyloxyethyl group, a 3-phenoxypropyl group, a 2-hexylsulfonylethyl group, a cyclopentyl group, a benzyl group, etc.), an aryl group (e.g., a phenyl group, 4-t-butylphenyl group, a 2,4-di-t-amylphenyl group, a4-tetradecanamidophenyl group, etc.), a heterocyclic group (e.g., a 2-furyl group, a 2-thienyl group, a 2-pyrimidinyl group, a 2-benzothiazolyl group, etc.), a cyano group, an alkoxy group (e.g., a methoxy group, an ethoxy group, a 2-methoxyethoxy group, a 2-dodecyloxyethoxy group, a 2-methanesulfonylethoxy group, etc.), an aryloxy group (e.g., a phenoxy group, a 2-methylphenoxy group, a 4-t-butylphenoxy group, etc.), a heterocyclic oxy group (e.g., a 2-benzimidazolyloxy group, etc.), an acyloxy group (e.g., an acetoxy group, a hexadecanoyloxy group, etc.), a carbamoyloxy group (e.g., an N-phenylcarbamoyloxy group, an N-ethylcarbamoyloxy group, etc.), a silyloxy group (e.g., a trimethylsilyloxy group, etc.), a sulfonyloxy group (e.g., a dodecylsulfonyloxy group, etc.), an acylamino group (e.g., an acetamido group, a benzamido group, a tetradecanamido group, an α-(2,4-di-t-amylphenoxy)butyramido group, a γ-(3-t-butyl-4-hydroxyphenoxy)butyramido group, an α-[4-(4-hydroxyphenylsulfonyl)phenoxy]decanamido group, etc.), an anilino group (e.g., a phenylamino group, a 2-chloroanilino group, a 2-chloro-5-tetradecanamidoanilino group, a 2-chloro-5-tetradecanamidoanilino group, a 2-chloro-5-dodecyloxycarbonylanilino group, an N-acetylanilino group, a 2-chloro-5-[α-(3-t-butyl-4-hydroxyphenoxy)-dodecanamido]anilino group, etc.), a ureido group (e.g., a phenylureido group, a methylureido group, an N,N-dibutylureido group, etc.), an imido group (e.g., an N-succinimido group, a 3-benzylhydantoinyl group, a 4-(2-ethylhexanoylamino)phthalimido group, etc.), a sulfamoyl group (e.g., an N,N-dipropylsulfamoylamino group, an N-methyl-N-decylsulfamoylamino group, etc.), an alkylthio group (e.g., a methylthio group, an octylthio group, a tetradecylthio group, a 2-phenoxyethylthio group, a 3-phenoxypropylthio group, a 3-(4-t-butylphenoxy)propylthio group, etc.), an arylthio group (e.g., a phenylthio group, a 2-butoxy-5-t-octylphenylthio group, a 3-pentadecylphenylthio group, a 2-carboxyphenylthio group, a 4-tetradecanamidophenylthio group, etc.), a heterocyclic thio group (e.g., a 2-benzothiazolylthio group, etc.), an alkoxycarbonylamino group (e.g., a methoxycarbonylamino group, a tetradecyloxycarbonylamino group, etc.), an aryloxycarbonylamino group (e.g., a phenoxycarbonylamino group, a 2,4-di-tert-butylphenoxycarbonylamino group, etc.), a sulfonamido group (e.g., a methanesulfonamido group, a hexadecanesulfonamido group, a benezenesulfonamido group, a p-toluenesulfonamido group, an octadecanesulfonamido group, a 2-methyloxy-5-t-butylbenzenesulfonamido group, etc.), a carbamoyl group (e.g., an N-ethylcarbamoyl group, an N,N-dibutylcarbamoyl group, an N-(2-dodecyloxyethyl)carbamoyl group, an N-methyl-N-dodecylcarbamoyl group, an N-[3-(2,4-di-tertamylphenoxy)propyl]carbamoyl group, etc.), an acyl group (e.g., an acetyl group, a (2,4-di-tert-amylphenoxy)acetyl group, a benzoyl group, etc.), a sulfamoyl group (e.g., an N-ethylsulfamoyl group, an N,N-dipropylsulfamoyl group, an N-(2-dodecyloxyethyl)sulfamoyl group, an N,N-diethylsulfamoyl group, dodecylsulfamoyl group, an N,N-diethylsulfamoyl group, etc.), a sulfonyl group (e.g., a methanesulfonyl group, an octanesulfonyl group, a benzenesulfonyl group, a toluenesulfonyl group, etc.), a sulfinyl group (e.g., an octanesulfinyl group, a dodecylsulfinyl group, a phenylsulfinyl group, etc.), an alkoxycarbonyl group (e.g., a methoxycarbonyl group, a butyloxycarbonyl group, a dodecyloxycarbonyl group, an octadecyloxycarbonyl group, etc.), or an aryloxycarbonyl group (e.g., a phenyloxycarbonyl group, a 3-pentadecylphenyloxycarbonyl group, etc.).

At least one of $R_3$, $R_4$ and $R_5$ and also $R_6$ represent branched alkyl group at the position directly bonded to the skeleton. Examples of the branched alkyl group are an isopropyl group, a t-butyl group, a t-hexyl group, a cyclohexyl group, an adamantyl group, a 1-ethoxyisopropyl group, a 1-phenoxy-1,1-dimethylmethyl group, an α,α-dimethylbenzyl group, an α,α-dimethylphenylethyl group, an α-ethylbenzyl group, a 1-ethyl-1-[4-(2-butoxy-5-tert-octylbenzenesulfonamido)phenyl]-methyl group, a 1-methyl-2-[4-(4-dodecyloxybenzenesulfonamido)phenyl]ethyl group, a 1-methyl-2-(2-octyloxy-5-tert-octylbenzenesulfonamido)ethyl group, a 1,1-2-(2-octyloxy-5-tert-octylbenzenesulfonamido)ethyl group, a 1-methyl-2-[2-octyloxy-5-(2-octyloxy-5-tert-octylbenzenesulfonamido)benzenesulfonamido]ethyl group, a 1-ethyl-2-(2-dodecyloxy-5-tert-octylbenzenesulfonamido)ethyl group, a 1-(2-hydroxyethyl)-2-{α-[3-(2-octyloxy-5-tert-octylbenzenesulfonamido)phenoxy]dodecanamido}ethyl group, etc.

Details of X are as follows.

X represents a hydrogen atom, a halogen atom (e.g., a chlorine atom, a bromine atom, an iodine atom, etc.), a group bonded through a carboxy group or an oxygen atom (e.g., an acetoxy group, a propanoyloxy group, a benzoyloxy group, a 2,4-dichlorobenzoyloxy group, an ethoxyoxaloyloxy group, a pyruvinyloxy group, a cinnamoyloxy group, a phenoxy group, a 4-cyanophenoxy group, a 4-methanesulfonamidophenoxy group, a 4-methanesulfonylphenoxy group, an α-naphthoxy group, a 3-pentadecylphenoxy group, a benzyloxycarbonyloxy group, an ethoxy group, a 2-cyanoethoxy group, a benzyloxy group, a 2-phenethyloxy group, a 2-phenoxyethoxy group, a 5-phenyltetrazolyloxy group, a 2-benzothiazolyloxy group, etc.), a group bonded through a nitrogen atom (e.g., a benzenesulfonamido group, an N-ethyltoluenesulfonamido group, a heptafluorobutanamido group, a 2,3,4,5,6-pentafluorobenzamido group, an octanesulfonamido group, a p-cyanophenylureido group, an N,N-diethylsulfamoylamino group, a 1-piperidyl group, a 5,5-dimethyl-2,4-dioxo-3-oxazolidinyl group, a 1-benzylethoxy-3-hydantoinyl group, a 2N-1,1-dioxo-3(2H)-oxo-1,2-benzoisothiazolyl group, a 2-oxo-1,2-dihydro-1-pyridinyl group, an imidazolyl group, a pyrazolyl group, a 3,5-diethyl-1,2,4-triazol-1-yl group, a 5- or 6-bromobenzotriazol-1-yl group, a 5-methyl-1,2,3,4-triazol-1-yl group, a benzimidazolyl group, a 3-benzyl-1-hydantoinyl group, a 1-benzyl-5-hexadecyloxy-3-hydantoinyl group, a 5-methyl-1-tetrazolyl group, etc.), an arylazo group (e.g., a 4-methoxyphenylazo group, a 4-pivaloylaminophenylazo group, a 2-hydroxy-4-propanolyphenylaze group, etc.), a group bonded through a sulfur atom (e.g., a phenylthio group, a 2-carboxyphenylthio group, a 2-methoxy-5-t-octylphenylthio group, a 4-methanesulfonylphenylthio group, a 4-octanesulfonamidophenylthio group, a 2-butoxyphenylthio group, a 2-(2-hexanesulfonylethyl)-5-tert-octylphenylthio group, a benzylthio group, a 2-cyanoethylthio group, a 1-ethoxycarbonyltridecylthio group, a 5-phenyl-2,3,4,5-tetrazolylthio group, a 2-benzothiazolylthio group, a 2-dodecylthio-5-thiophenylthio group, a 2-phenyl-3-dodecyl-1,2,4-triazolyl-5-thio group, etc.).

When $R_3$, $R_4$, $R_5$ or X is a divalent group to form a bis compound, the divalent group represents a substituted or unsubstituted alkylene group (e.g., a methylene group, an ethylene group, a 1-ethylethylene group, a 1,10-decylene group, $-CH_2CH_2-O-CH_2CH_2-$, etc.), a substituted or unsubstituted phenylene group (e.g., a 1,4-phenylene group, a 1,3-phenylene group,

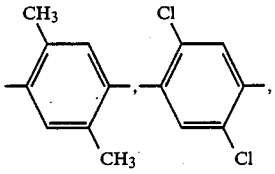

etc.), or $=NHCO-R_7-CONH-$ (wherein $R_7$ represents a substituted or unsubstituted alkylene group or a substituted or unsubstituted phenylene group).

When $R_6$ is a divalent group to form a bis compound, the divalent group becomes a branched alkylene group at the position that the above-described alkylene group is bonded to the skeleton.

When the coupler represented by general formulae (I-1) to (I-5) is in a vinyl monomer, the linkage group shown by $R_3$, $R_4$ or $R_5$ includes a group formed by a combination of the groups selected from a substituted or unsubstituted alkylene group (such as a methylene group, an ethylene group, a 1-methylethylene group, a 1,10-decylene group, $-CH_2CH_2OCH_2CH_2-$, etc.), a substituted or unsubstituted phenylene group (such as a 1,4-phenylene group, a 1,3-phenylene group,

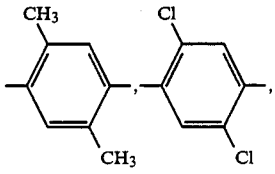

etc.), —NHCO—, —CONH—, —O—, —OCO— and an aralkylene group (e.g.,

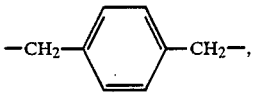

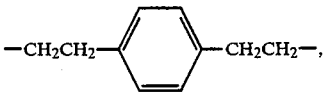

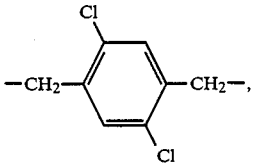

etc.). Also, the alkylene linkage group shown by $R_6$ becomes a branched alkylene group at the position that the above-described alkylene group is bonded to the skeleton.

In addition, the vinyl group in the vinyl monomer includes a case that the vinyl group also has a substituent other than those described above as the substituents for the couplers shown by the above general formulae (I-1) to (I-5). Preferred examples for the vinyl group are a hydrogen atom, a chlorine atom or a lower alkyl group having 1 to 4 carbon atoms.

As described above, the polymer couplers in this invention may be a copolymer of the vinyl monomer having the moiety shown by general formula (I) and a non-coloring ethylenical monomer which does not cause coupling reaction with the oxidation product of an aromatic primary amine developing agent and examples of such a non-coloring ethylenical monomer are acrylic acid, $\alpha$-chloroacrylic acid, $\alpha$-alkyl-substituted acrylic acid (e.g., methacrylic acid, etc.), esters or amides induced from these acrylic acids (e.g., acrylamide, n-butylacrylamide, t-butylacrylamide, diacetonacrylamide, methacrylamide, methyl acrylate, ethyl acrylate, n-propyl acrylate, n-butyl acrylate, t-butyl acrylate, isobutyl acrylate, 2-ethylhexyl acrylate, n-octyl acrylate, lauryl acrylate, methyl methacrylate, ethyl methacrylate, n-butyl methacrylate, $\beta$-hydroxyethyl methacrylate, etc.), methylenedibisacrylamide, vinyl esters (e.g., vinyl acetate, vinyl propionate, vinyl laurate, etc.), acrylonitrile, methacrylonitrile, aromatic vinyl compounds (e.g., styrene, the derivatives of styrene, vinyltoluene, divinylbenzene, vinylacetophenone, sulfostyrene, etc.), itaconic acid, citraconic acid, crotonic acid, vinylidene chloride, vinyl alkyl ethers (e.g., vinyl ethyl ether, etc.), maleic acid, maleic anhydride, maleic acid esters, N-vinyl-2-pyrrolidone, N-vinylpyridine, 2-vinylpyridine, 4-vinylpyridine, etc. The non-coloring ethylenical monomers may be used solely or as a combination of them.

The couplers shown by the above-described general formulae (I-1) to (I-5) can be prepared according to the synthesis methods described in the following literature.

That is, the couplers shown by general formula (I-1) can be prepared according to the methods described in Japanese Patent Application (OPI) No. 162548/84, etc., the couplers shown by general formula (I-2) according to the methods described in Japanese Patent Application (OPI) No. 171956/84, etc., the couplers shown by general formula (I-3) according to the methods described in U.S. Pat. No.3,725,067, etc., the couplers shown in general formula (I-4) according to the methods described in Japanese Patent Application (OPI) No. 33552/85, etc., and the couplers shown by general formula (I-5) according to the methods described in U.S. Pat. Nos. 3,061,432, 3,369,897, etc.

Specific examples of the pyrazoloazole series couplers for use in this invention are illustrated below but the couplers for use in this invention are not limited these compounds.

M-1
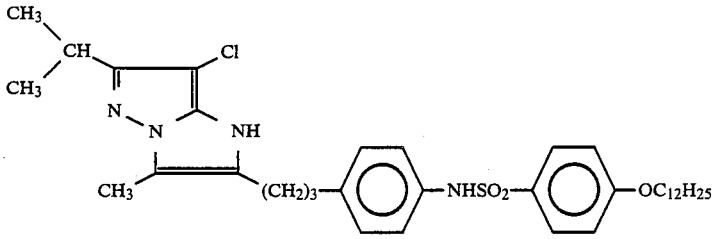
M-2
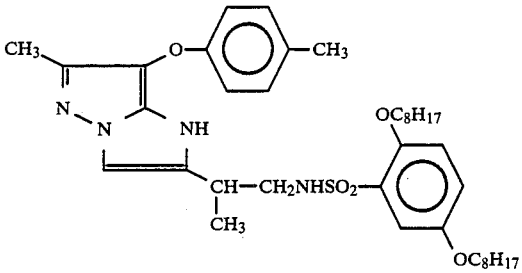
M-3
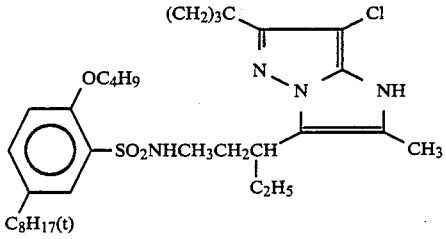
M-4
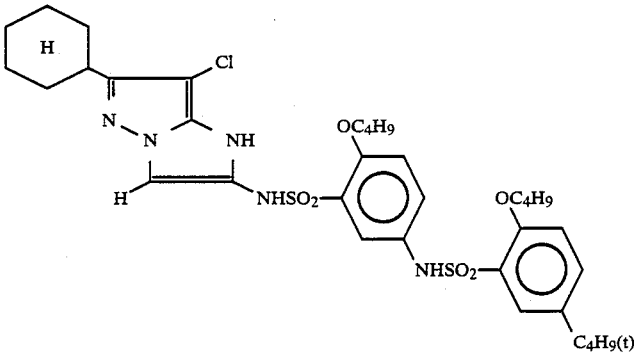
M-5
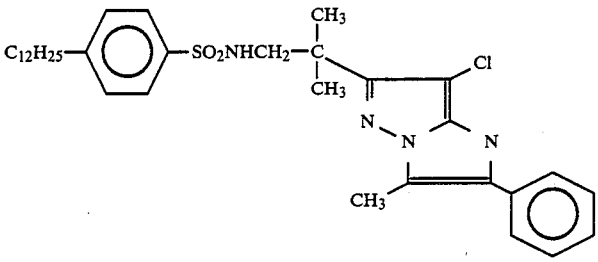

-continued
M-6
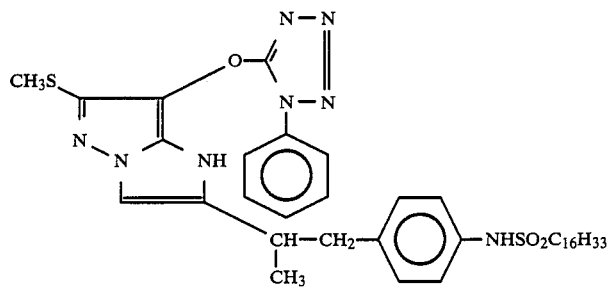
M-7
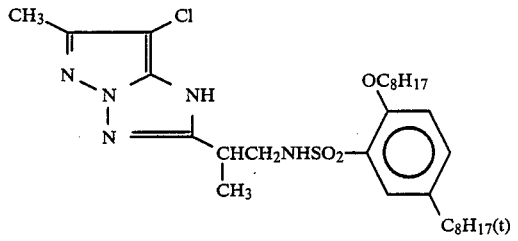
M-8
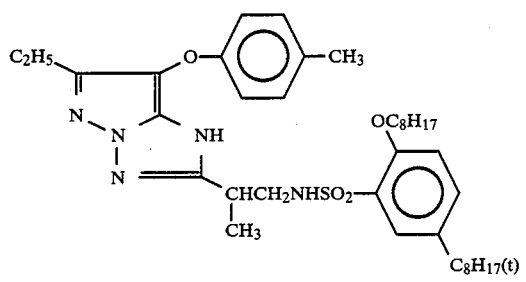
M-9
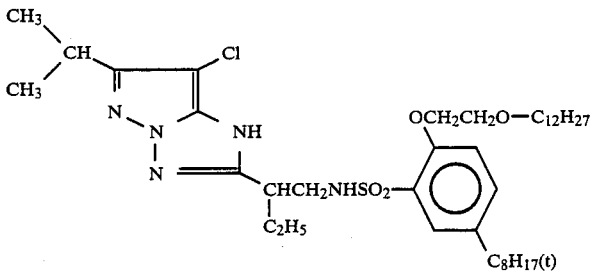
M-10
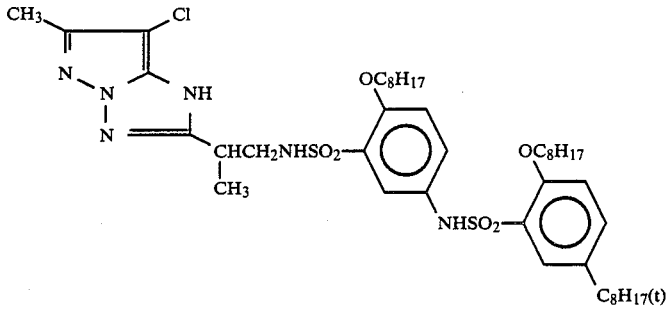

-continued
M-11
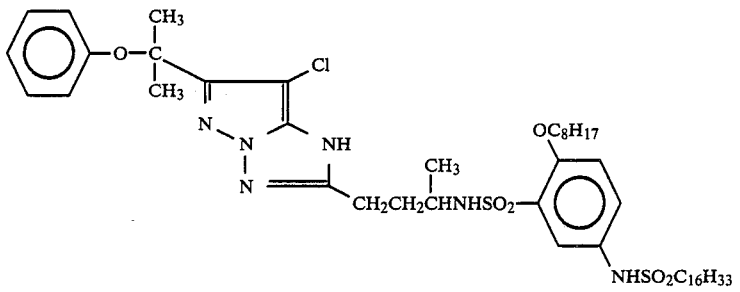
M-12
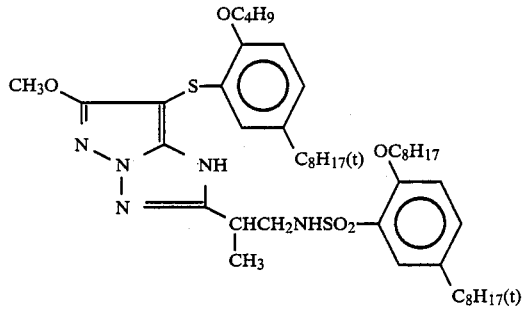
M-13
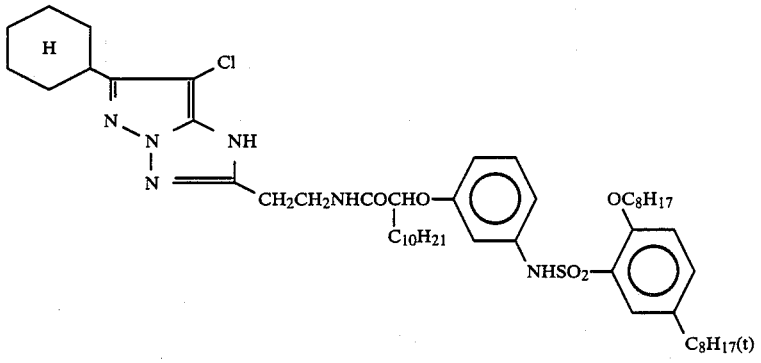
M-15
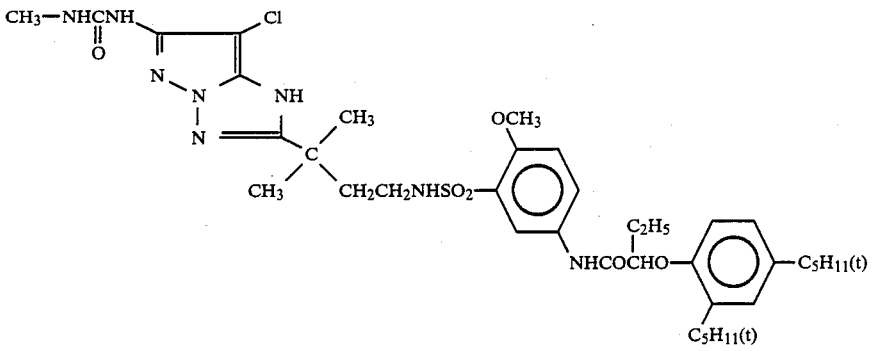
M-16
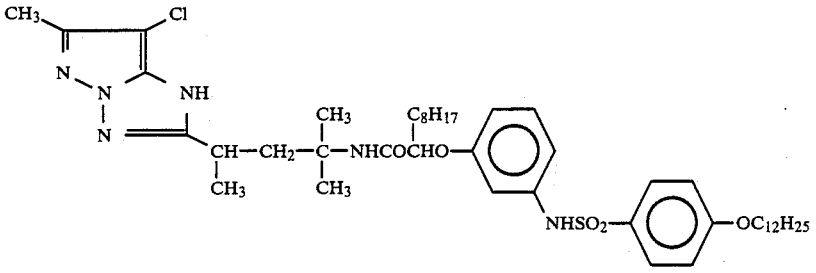

-continued
M-17
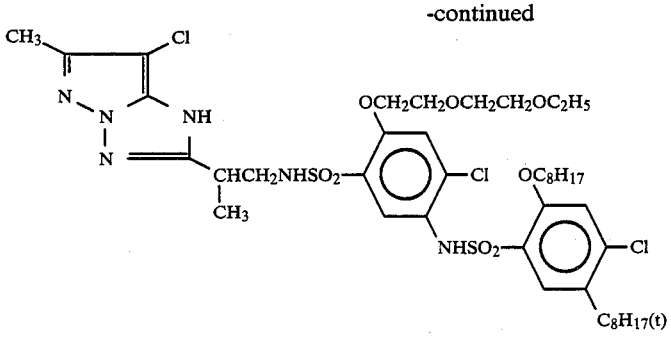
M-18
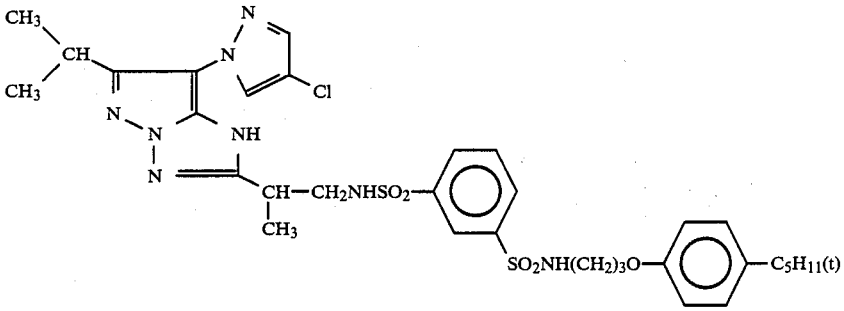
M-19
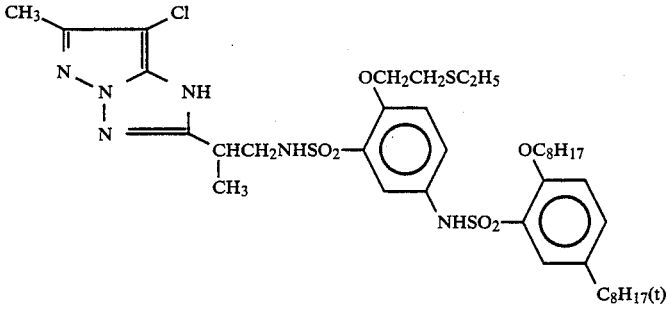
M-20
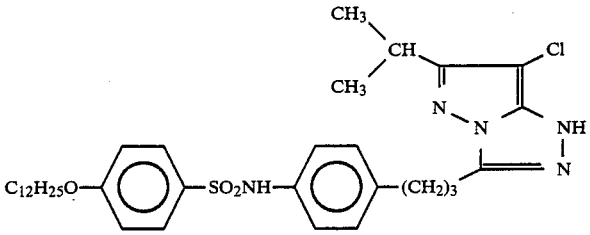
M-21
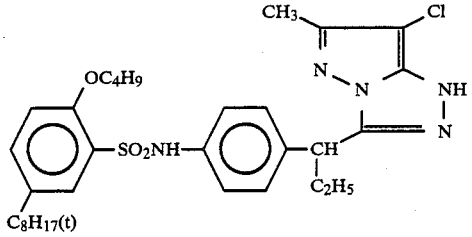
M-22
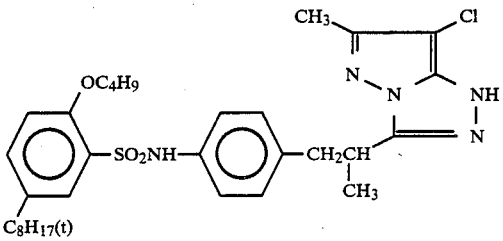

-continued
M-23
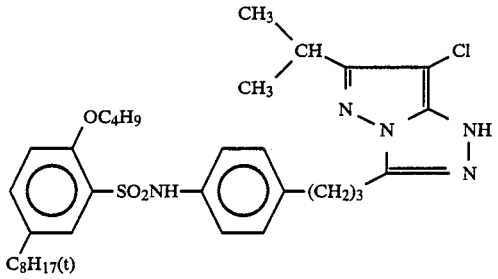
M-24
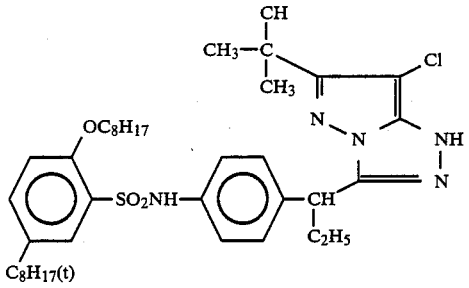
M-25
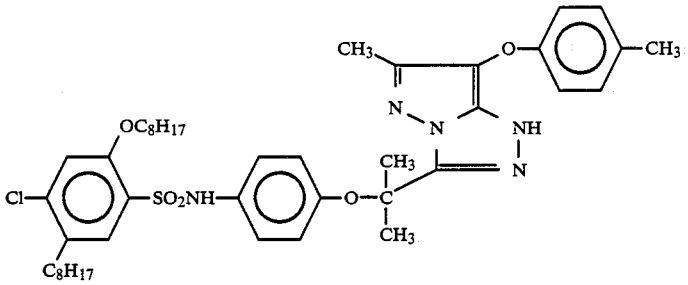
M-26
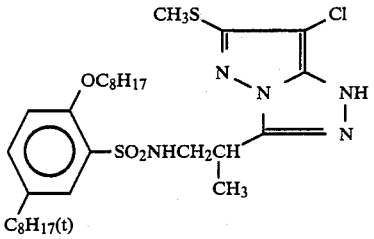
M-27
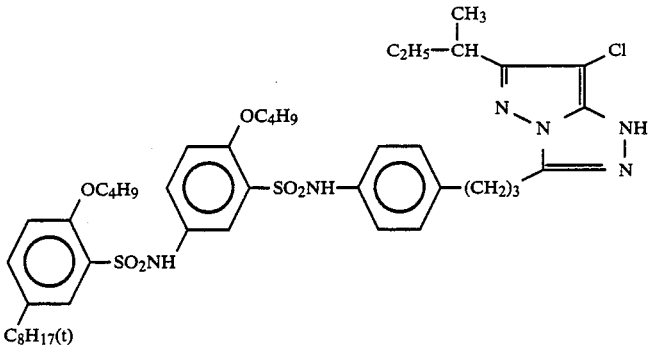

-continued
M-28
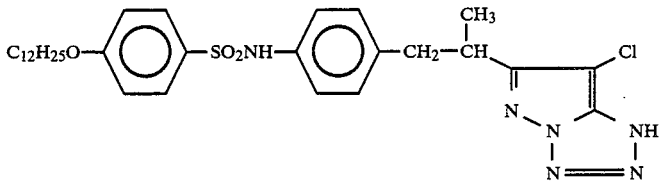
M-29
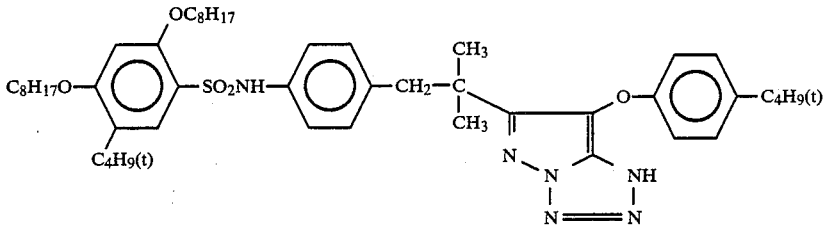
M-30
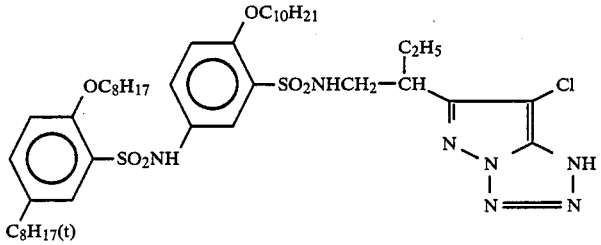
M-31
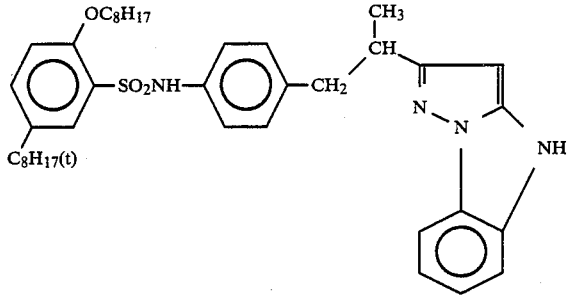
M-32
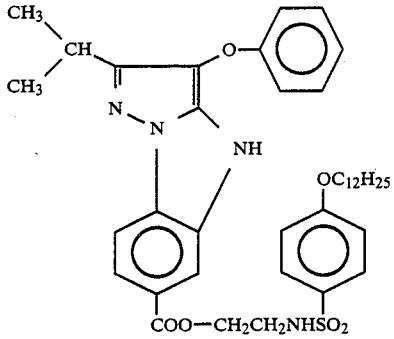

-continued

M-33

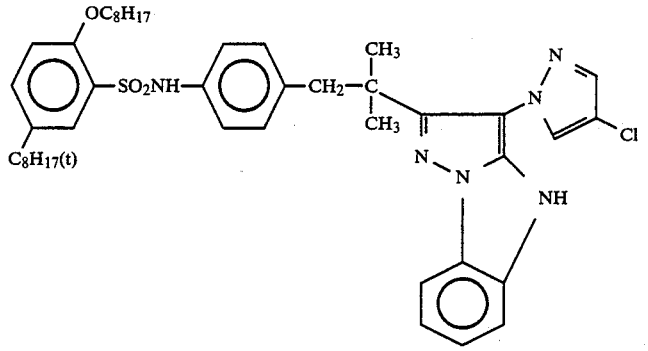

The magenta coupler of general formula (I) for use in this invention can be incorporated in a hydrophilic organic colloid for forming a photographic light-sensitive layer together with a high boiling organic solvent as a dispersion therein. The preferred ratio of the magenta coupler described above to the silver halide in the magenta coloring silver halide emulsion layer is 0.05 to 5 mol.

For introducing the magenta coupler in a silver halide emulsion layer, the method as described, for example, in U.S. Pat. No. 2,322,027 is generally used.

In addition, the ratio of a high boiling organic solvent to the above-described pyrazoloazole magenta coupler is preferably 0 to 6.0. When the high boiling organic solvent has an insufficient solubility for the coupler, a coupler solvent such as, for example, a phosphoric acid ester series coupler solvent, etc., can be used. Also, in this invention, in the case of dissolving the coupler in a coupler solvent, a low boiling organic solvent having boiling point of about 30° to 150° C., such as a lower alkyl acetate (e.g., ethyl acetate, butyl acetate, etc.), an ethyl propionate, secondary butyl alcohol, methyl isobutyl ketone, β-ethoxyethyl acetate, methyl cellosolve acetate, etc., may used together.

In the case of introducing the coupler dissolved in a coupler solvent into an emulsion for forming a silver halide emulsion layer by the abovedescribed method, a dispersion method by a polymer as described, for example, in Japanese Patent Publication No. 39853/76 and Japanese Patent Application (OPI) No. 59943/76 can be also used.

When the coupler has an acid group such as carboxylic acid, sulfonic acid, etc., the coupler can be introduced into an aqueous hydrophilic colloid solution as an alkaline aqueous solution thereof.

In this invention, various color couplers can be used in addition to the above-described magenta couplers. In this invention, the color coupler is a compound capable of forming a dye by causing a coupling reaction with the oxidation product of an aromatic primary amine developing agent. Typical examples of the useful color couplers for use in this invention are naphtholic or phenolic compounds, pyrazolone series or pyrazoloazole series compounds, and open chain or heterocyclic ketomethylene compounds. Specific examples of cyan couplers, magenta couplers and yellow couplers which can be used in this invention are described in the patents cited in *Research Disclosure,* No. 17643 (December, 1978), VII-D and ibid., No. 18716 (November, 1979).

It is preferred that the color couplers existing in a light-sensitive material are rendered nondiffusible by having a ballast group or by being polymerized. Also, a 2-equivalent coupler the coupling active position of which is substituted by a coupling-off group is more preferred than a 4-equivalent group the coupling active position of which has a hydrogen atom in the point capable of reducing the coating amount of silver. Furthermore, a coupler forming a colored dye having a proper diffusibility, a colorless compound forming coupler, a DIR coupler releasing a development inhibitor with coupling reaction, or a coupler releasing a development accelerator can be also used in this invention.

Typical examples of the yellow couplers which can be used in this invention are oil-protect type acylacetamide series yellow couplers and specific examples thereof are described in U.S. Pat. Nos. 2,407,210, 2,875,057, 3,265,506, etc. In this invention, the use of 2-equivalent yellow couplers is preferred and typical examples thereof are yellow couplers having a coupling-off group containing an oxygen atom as a coupling-off atom as described in U.S. Pat. Nos. 3,408,194, 3,447,928, 3,933,501, 4,022,620, etc., and yellow couplers having a coupling-off group containing a nitrogen atom as a coupling-off atom as described in Japanese Patent Publication No. 10739/83, U.S. Pat. Nos. 4,401,752, 4,326,024, *Research Disclosure,* No. 18053 (April, 1979), British Patent 1,425,020, West German Patent Application (OLS) Nos. 2,219,917, 2,261,361, 2,329,587, 2,433,812, etc. In these couplers, α-pivaloylacetanilide series yellow couplers are excellent in the fastness, in particular, light fastness of the colored dye formed, on the other hand, α-benzoylacetanilide series yellow couplers can give high coloring density.

As the cyan couplers which can be used in this invention, there are oil-protect type naphtholic or phenolic couplers. Specific examples of the oil-protect type naphtholic couplers are the naphtholic couplers described in U.S. Pat. No. 2,474,293 and, preferably, 2-equivalent naphtholic couplers having a coupling-off group containing an oxygen atom as a coupling-off atom as described in U.S. Pat. Nos. 4,052,212, 4,146,396, 4,228,233, 4,296,200, etc. Also, specific examples of the oil-protect type phenolic couplers are described in U.S. Pat. Nos. 2,369,929, 2,801,171, 2,772,162, 2,895,826, etc. Cyan couplers having high fastness to humidity and typical examples of such a cyan couplers are the phenolic cyan couplers having an alkyl group of at least 2 carbon atoms at the meta-position of the phenol nucleus described in U.S. Pat. No. 3,772,002, the 2,5-diacylaminosubstituted phenolic couplers described in U.S. Pat. Nos. 2,772,162, 3,758,308, 4,126,396, 4,334,011, 4,327,173, West German Patent Application (OLS) No. 3,329,729, European Patent No. 121,365, etc., and the phenolic couplers having a phenylureido group at the 2-position and an acylamino group at the 5-position described in U.S. Pat. Nos. 3,446,622, 4,333,999, 4,451,559, 4,427,767, etc.

For correcting unnecessary absorptions in a short wavelength region of dyes formed from magenta couplers and cyan couplers, colored couplers are preferably used for color photographic negative materials. Typical examples of the colored coupler are the yellow-colored magenta couplers described in U.S. Pat. No. 4,163,670, Japanese Patent Publication No. 39413/82 and the magenta-colored cyan couplers described in U.S. Pat. Nos. 4,004,929, 4,138,258, British Patent No. 1,146,368, etc.

In this invention, the grainness of color images formed can be improved by using couplers giving colored dyes having proper diffusibility together with the above-described couplers. Specific examples of such a coupler are described in U.S. Pat. No. 4,366,237 and British Patent No. 2,125,570 for magenta couplers, in European Patent No. 96,570 and West German Patent Application (OLS) No. 3,234,533 for yellow couplers and cyan couplers.

The dye-forming couplers and the specific couplers described above each may form a dimer or polymer. Typical examples of the polymerized dye-forming coupler are described in U.S. Pat. Nos. 3,451,820 and 4,080,211. Specific examples of the polymerized magenta couplers are described in British Patent No. 2,102,173 and U.S. Pat. No. 4,367,282.

As the binder or protective colloid which can be used for silver halide emulsion layers of the photographic light-sensitive materials of this invention, gelatin is advantageously used but other hydrophilic colloid can be used solely or together with gelatin.

As gelatin, lime-treated gelatin or gelatin treated using an acid can be used. Details of gelatin are described, for example, in Arthur Veis, *The Macromolecular molecular Chemistry of Gelatin* (published by Academic Press, 1964).

For the photographic emulsion layers of the photographic light-sensitive materials of this invention, silver bromide, silver iodobromide, silver iodochlorobromide, silver chlorobromide or silver chloride can be used as the silver halide. The use of silver chlorobromide is preferred and also silver chlorobromide containing 20 mol % to 100 mol % silver bromide is particularly preferred. For the purpose of rapid processing, the use of silver chlorobromide containing not more than 10 mol % silver bromide is preferred.

There is no particular restriction about the mean grain size (shown by the diameter of the grain when the grain is sphere or a grain similar to sphere, or shown by a mean value based on the projected area using the long side length as the grain size when the grain is a cubic grain) of silver halide grains in the photographic emulsion but the mean grain size is preferably at most 2 μm.

The grain size distribution may be narrow or broad.

The silver halide grains in the photographic emulsion layer in this invention may have a regular crystal form such as a cube and an octahedron or an irregular crystal form such as spherical form and a tabular form. Also, the silver halide grains may be a composite form of these crystal forms or may be composed of a mixture of silver halide grains having various crystal forms.

Also, a tabular grain silver halide emulsion wherein very tabular silver halide grains having a diameter more than 5 times the thickness thereof account for at least 50% of the total projected area of the silver halide grains can be used in this invention.

The silver halide grains may have different phase between the inside and the surface layer thereof. The silver halide grains may be a type that a latent image is mainly formed at the surface thereof or of a type that a latent image is mainly formed in the inside thereof.

The silver halide photographic emulsions for use in this invention can be prepared by the methods described in P. Glafkides, *Chimie et Physique Photographique* (Paul Montel, 1967), G. F. Duffin, *Photographic Emulsion Chemistry* (Focal Press, 1966), V. L. Zelikman et al., *Making and Coating Photographic Emulsion* (Focal Press, 1964), etc. That is, the silver halide emulsions may be prepared by an acid method, a neutralization method, an ammonia method, etc. Also, as a method for reacting a soluble silver salt and a soluble halide, a single jet method, a double jet method, or a combination thereof may be used.

Also, a so-called reverse mixing method for forming silver halide grains in the existence of excessive silver ion can be used. As one system of the double jet method, a so-called controlled double jet method for maintaining the pAg in the liquid phase of forming silver halide grains at a constant value during the formation thereof can be employed. According to the method, a silver halide emulsion wherein the crystal form of silver halide grains is regular and the silver halide grain sizes are almost uniform can be obtained.

A mixture of two or more kinds of silver halide emulsions separately prepared can be used in this invention.

The silver halide grains may be formed or physically ripened in the coexistence of a cadmium salt, a zinc salt, a lead salt, a thallium salt, an iridium salt or a complex salt thereof, a rhodium salt or a complex salt thereof, an iron salt or a complex salt thereof, etc.

The silver halide emulsions for use in this invention are usually chemically sensitized. For the chemical sensitization, the methods described, for example, in H. Frieser, *Die Grundlagen der Photographischen Prozesse mit Silberhalogeniden,* pages 675 to 734 (Akademische Verlagsgesellschaft, 1968) can be used.

That is, there are a sulfur sensitization method using active gelatin or a sulfur-containing compound capable of reacting with silver (e.g., thiosulfates, thioureas, mercapto compounds, rhodanines, etc.); reduction sensitization method using a reducing material (e.g., stannous salts, amines, hydrazine derivatives, formamidine sulfinic acid, silane compounds, etc.); and a noble metal sensitization method using a noble metal compound (e.g., gold complex salts as well as complex salts of metals belonging to Group VIII of the Periodic Table, such as platinum, iridium, palladium, etc.). They can be used individually or as a combination thereof.

The silver halide photographic emulsions for use in this invention can contain various compounds for preventing the formation of fog during the production, storage, or photographic processing of the light-sensitive materials of this invention or stabilizing the photographic performance thereof. For example, there are many compounds known as antifoggants or stabilizers, for example, azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (in particular, 1-phenyl-5-mercaptotetrazole, etc.), mercaptopyrimidines, mercapto triazines, etc.; thioketo compounds such as oxazolinethione, etc.; azaindenes such as triazaindenes, tetraazaindenes (in particular, 4-hydroxy-substituted (1,3,3a,7)tetraazaindene, etc.), pentaazaindenes, etc.; benzenethiosulfonic acid, benzenesulfinic acid, benzenesulfonic acid amide, etc.

The photographic light-sensitive materials of this invention may contain in the photographic emulsion layers or other hydrophilic colloid layers various surface active agents for various purposes such as coating aid, static prevention, the improvement of slidability, the improvement of emulsified dispersibility, sticking prevention, and the improvement of photographic properties (e.g., development acceleration, increase of contrast, increase of sensitivity, etc.).

Also, the photographic light-sensitive materials of this invention may contain in the photographic emulsion layers polyalkylene oxide or the derivatives thereof such as the ethers, esters, amines, etc., thereof, thioether compounds, thiomorpholines, quaternary ammonium salt compounds, urethane derivatives, urea derivatives, imidazole derivatives, 3-pyrazolidones, etc., for the purpose of increasing sensitivity, increasing contrast, or development acceleration.

The photographic light-sensitive materials for use in this invention may further contain a dispersion of a water-insoluble or water sparingly soluble synthetic polymer in the photographic emulsion layers or other hydrophilic colloid layers for improving the dimensional stability, etc.

The silver halide photographic emulsions for use in this invention may be spectrally sensitized by purpose, there are cyanine dyes, merocyanine dyes, complex cyanine dyes, complex merocyanine dyes, holopolar cyanine dyes, hemicyanine dyes, styryl dyes, and hemioxonol dyes. Particularly useful dyes are cyanine dyes, merocyanine dyes, and complex merocyanine dyes.

For these dyes can be applied nuclei which are usually utilized for cyanine dyes as basic heterocyclic nuclei. Examples of these nuclei are pyrroline nuclei, oxazoline nuclei, thiazoline nuclei, pyrrole nuclei, oxazole nuclei, thiazole nuclei, selenazole nuclei, imidazole nuclei, tetrazole nuclei, pyridine nuclei, etc.; the nuclei formed by fusing alicyclic hydrocarbons to these nuclei and the nuclei formed by fusing aromatic hydrocarbons to these nuclei, such as indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei, quinoline nuclei, etc. These nuclei may be substituted on carbon atoms.

Also, for merocyanine dyes or complex merocyanine dyes can be applied 5-membered or 6-membered heterocyclic nuclei such as pyrazolin-5-one nuclei, thiohydantoin nuclei, 2-thiooxazolidine-2,4-dione nuclei, thiazolidine-2,4-dione nuclei, rhodanine nuclei, thiobarbituric acid nuclei, etc., as the nuclei having a ketomethylene structure.

These sensitizing dyes may be used solely or as a combination of them. A combination of sensitizing dyes is frequently used for the purpose of supersensitization.

A dye which does not have a spectral sensitizing action by itself or a material which does not substantially absorb visible light but show a supersensitizing action may be used in the photographic emulsions for use in this invention together with the above-described sensitizing dyes. For example, aminostyryl compound substituted by a nitrogen-containing heterocyclic group (described, for example, in U.S. Pat. Nos. 2,933,390, 3,635,721, etc.), aromatic organic acid-formaldehyde condensation products (described, for example, in U.S. Pat. No. 3,743,510, etc.), cadmium salts, azaindene compounds, etc.

This invention can be applied for a multilayer multicolor photographic light-sensitive material having two or more silver halide emulsion layers each showing different spectral sensitivity on a support. A multilayer natural color photographic light-sensitive material usually has at least one red-sensitive emulsion layer, at least one green-sensitive emulsion layer and at least one blue-sensitive emulsion layer on a support. The disposition order of the emulsion layers can be optionally selected according to need. Usually, a red-sensitive emulsion layer contains a cyan-forming coupler, a green-sensitive emulsion layer contains a magenta-forming coupler, and a blue-sensitive emulsion layer contains a yellow-forming coupler but, as the case may be, other combination of the emulsion layers and couplers can be employed.

The photographic light-sensitive material of this invention may further contain in the same or different photographic emulsion layers or insensitive layers thereof other dye-forming coupler, that is, a compound capable of coloring by oxidative coupling with an aromatic primary amine developing agent (e.g., a phenylenediamine derivative, an aminophenol derivative, etc.) in color photographic process together with the above-described couplers shown by the above general formula (I). As such magenta couplers, there are 5-pyrazolone couplers, pyrazolonebenzimidazole couplers, pyrazolo[5,1-c][1,2,4]triazole couplers, pyrazolopyrazole couplers, pyrazolotetrazole couplers, open chain acylacetonitrile couplers, etc. As such yellow couplers, there are acylacetamide couplers (e.g., benzoylacetanilides, pivaloylacetanilides, etc.), etc. Also, as such cyan couplers, there are naphthol couplers, phenol couplers, etc. It is preferred that these couplers are nondiffusible couplers having a hydrophobic group called as a ballast group in the molecule or polymerized couplers. The couplers may be of 4-equivalent or 2-equivalent to the silver ion. Also, these couplers may be colored couplers having a color correction effect or so-called DIR couplers releasing a development inhibitor with development.

Also, in place of the DIR couplers, non-coloring DIR coupling compounds providing non-coloring products upon the coupling reaction and releasing a development inhibitor may be used in this invention. Furthermore, the photographic light-sensitive materials of this invention may contain a coupler or a compound releasing a development accelerator with the progress of development.

The couplers as defined in this invention and the above-described specific couplers may be used in the same photographic emulsion layer as a mixture of two or more thereof or the same compound may exist in two or more emulsion layers for meeting the characteristics required for the light-sensitive material.

The photographic light-sensitive materials of this invention may further contain in the photographic emulsion layers and other hydrophilic colloid layers inorganic or organic hardening agents, such as chromium salts (e.g., chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloyl-hexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.), etc. They can be used solely or as a combination thereof.

When the light-sensitive materials of this invention contain an ultraviolet absorbent in the hydrophilic colloid layers, the ultraviolet absorbent may be mordanted to a cationic polymer.

The light-sensitive materials of this invention may contain hydroquinone derivatives, aminophenol derivatives, gallic acid derivatives, ascorbic acid derivatives, etc., as color fog preventing agents.

The photographic light-sensitive materials of this invention may further contain ultraviolet absorbents in the hydrophilic colloid layers as described above. Examples of the ultraviolet absorbent are benzotriazole compounds substituted by an aryl group (described, for example, in U.S. Pat. No. 3,533,794, etc.), 4-thiazolidone compounds (described, for example, in U.S. Pat. Nos. 3,314,794, 3,352,681, etc.), benzophenone compounds (described, for example, in Japanese Patent Application (OPI) No. 2784/71, etc.), cinnamic acid ester compounds (described, for example, in U.S. Pat. Nos. 3,705,805, 3,707,375, etc.), butadiene compounds (described, for example, in U.S. Pat. No. 4,045,229, etc.), and benzoxydol compounds (described, for example, in U.S. Pat. No. 3,700,455, etc.).

Moreover, ultraviolet absorbing couplers (e.g., $\alpha$-naphtholic cyan dye-forming couplers, etc.) and ultraviolet absorbing polymers can be used. These ultraviolet absorbents may be mordanted to specific layers.

The photographic light-sensitive materials of this invention may contain water-soluble dyes as filter dyes or various purposes such as irradiation prevention, etc. Examples of such dyes are oxonol dyes, hemioxonol dyes, styryl dyes, merocyanine dyes, cyanine dyes, and azo dyes. In these dyes, oxonol dyes, hemioxonol dyes, and merocyanine dyes are particularly useful.

At the practice of this invention, the following fading preventing agents or dye image stabilizers can be used solely or a combination thereof. Examples of fading preventing agent are hydroquinone derivatives, gallic acid derivatives, p-alkoxyphenols, p-oxyphenol derivatives and bisphenols.

The final bath which is used in the process of this invention is a bath which is disposed at the end of the processing steps and usually means a bath which is used directly before drying the processed light-sensitive materials. As the final bath, water wash bath or stabilization bath is generally used but other baths may be used.

When the final bath is a water wash bath, it is necessary that the wash step is a multistage countercurrent wash step using two or more baths, preferably three to nine baths. The wash bath(s) may contain various additives, for example, water softeners such as inorganic phosphoric acids, aminopolycarboxylic acids, organic phosphoric acids, etc., sterilizers for preventing the growth of various bacteria and algae, hardening agents such as magnesium salts, aluminum salts, etc., and surface active agents for preventing drying load and the occurrence of uneven drying. Other examples of these additives are described in L. E. West, *Water Quality Criteria, Photographic Science Engineering,* Vol. 9, No. 6 (1965), etc.

When the final bath is a stabilization bath, the prior bath may be one or more wash baths and also may be a multistage countercurrent stabilization step without using wash step as described in Japanese Patent Application (OPI) No. 8543/82, etc. In the case of the multistage countercurrent stabilization step, two to nine baths are required.

The stabilization baths described above may contain various compounds. For example, there are buffers such as borates, metaborates, borax, phosphates, carbonates, potassium hydroxide, sodium hydroxide, aqueous ammonia, monocarboxylic acids, dicarboxylic acids, polycarboxylic acids, etc.; water softeners such as inorganic phosphoric acids, aminopolycarboxylic acids, organic phosphoric acids, aminopolyphosphoric acids, phosphonocarboxylic acids, etc. Other examples of the additives are antimolds such as proxel, 4-thiazolylbenzimidazole, isothiazolone, benzotriazole, etc., and hardening agents or surface active agents such as formalin, aluminum salts, magnesium salts, etc.

Also, the stabilization bath may contain various ammonium salts such as ammonium chloride, ammonium nitrate, ammonium sulfate, ammonium phosphate, ammonium sulfite, ammonium thiosulfate, etc., as a film pH adjusting agent after processing.

The addition of a water softener and an antimold is particularly preferred.

Furthermore, it is necessary that the final bath contains at least $1\times10^{-4}$ mol/liter of a soluble iron salt. In this case, the soluble iron salt means an iron salt which is in the form of substantially a complex with a chelating agent in the bath. The chelating agent which forms the soluble iron salt is preferably a compound having at least two atoms or groups selected from a nitrogen atom, a carboxylic group, a phosphoric acid group and a hydroxyl group which can coordinate. More preferably, the chelating agent is a compound having at least three atoms or groups aforesaid. Specific examples of these chelating agents are illustrated below although they are not limited to them.

$Na_4P_4O_{12}$ F-1

$Na_6P_4O_{13}$ F-2

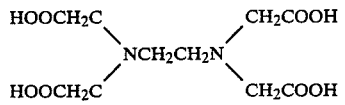

F-3

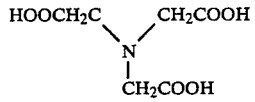

F-4

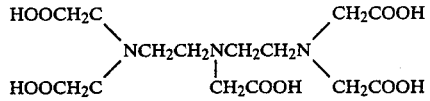

F-5

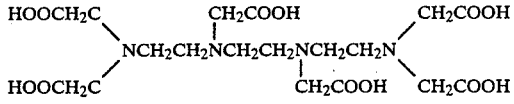

F-6

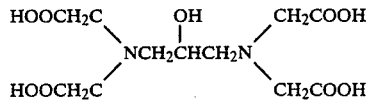

F-7

-continued
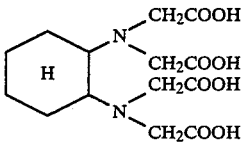
F-8
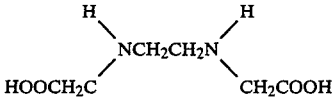
F-9
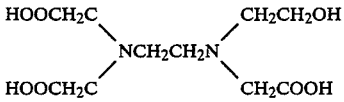
F-10
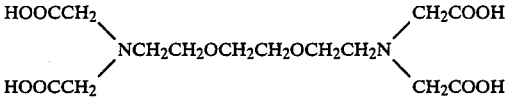
F-11
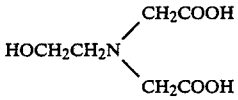
F-12
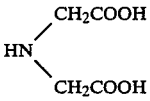
F-13
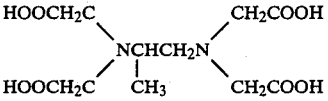
F-14
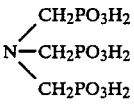
F-15
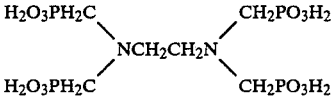
F-16
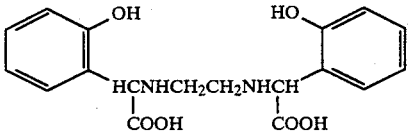
F-17
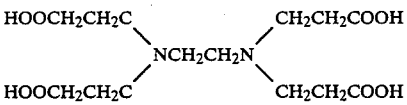
F-18
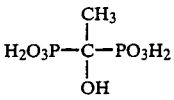
F-19
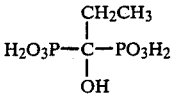
F-20
-continued
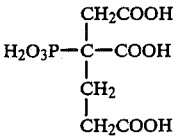
F-21
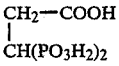
F-22
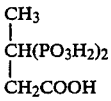
F-23
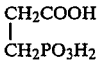
F-24
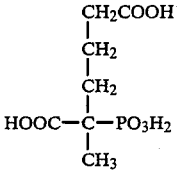
F-25
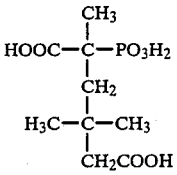
F-26
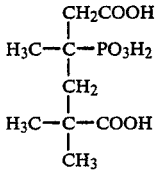
F-27
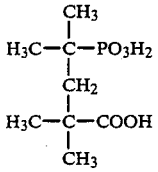
F-28
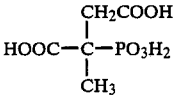
F-29
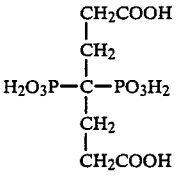
F-30
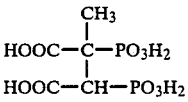
F-31

-continued

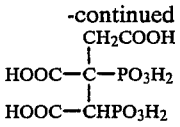

F-32

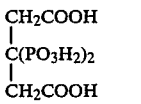

F-33

The carboxylic acid group or the phosphonic acid group of these chelating agents may form a salt with sodium, potassium, ammonium, lithium, etc.

The final bath for use in this invention can contain the above-described soluble iron salt in an amount of $1\times10^{-4}$ mol to $1\times10^{-1}$ mol, preferably $1.5\times10^{-4}$ mol to $1\times10^{-2}$ mol, per liter of the final bath.

The above-described soluble iron salt may exist in the final bath from the first or may exist in a bleach solution or a bleach-fix (blix) solution, which is a prebath for the final bath. For example, ethylenediamine iron complex salts or triethylenetetramine iron complex salts may be carried in the final bath with light-sensitive materials at the above-described concentration. When the final bath in this invention is a multistage countercurrent wash step, the amount of washing water can be reduced to one several tenth to one several hundredth for keeping the above-described concentration of the soluble iron salt.

The pH of the final bath in this invention is about 3 to 9. If the pH is outside the above range, the light fading preventing faculty of the magenta dye is reduced. The temperature of the final bath is 5° C. to 40° C., preferably 10° C. to 35° C.

The processing process of this invention can be applied for processing any general silver halide color photographic materials such as color photographic negative films, color photographic papers, color photographic positive films, color photographic reversal films, etc., but is particularly preferably applied for processing color photographic papers.

The typical processing steps in this invention are shown below but not to limit the invention in any way.

A. Color development→Blix→Wash→Drying.

B. Color development→Blix→Wash→Stabilization→Drying.

C. Color development→Blix→Stabilization→Drying.

D. Color development→Wash→Blix→Wash→Drying.

E. Color development→Bleach→Fix→Wash→Stabilization→Drying.

F. Color development→Bleach→Fix→Wash→Drying.

G. Color development→Bleach→Fix→Stabilization→Drying.

The color developer for use in this invention contains a color developing agent. Preferred examples thereof are p-phenylenediamine derivatives and specific examples thereof are shown below.

D-1 N,N-Diethyl-p-phenylenediaxine

D-2 2-Amino-5-diethylaminotoluene

D-3 2-Amino-5-(N-ethyl-N-laurylamino)toluene

D-4 4-[N-Ethyl-N-(β-hydroxyethyl)amino]aniline

D-5 2-Methyl-4-[N-ethyl-N-(β-hydroxyethyl)amino]-aniline

D-6 N-Ethyl-N-(β-methanesulfonamidoethyl)-3-methyl-4-aminoaniline

D-7 N-(2-Amino-5-diethylaminophenylethyl)methanesulfonamide

D-8 N,N-Dimethyl-p-phenylenediamine

D-9 4-Amino-3-methyl-N-ethyl-N-methoxyethylaniline

D-10 4-Amino-3-methyl-N-ethyl-N-β-ethoxyethylaniline

D-11 4-Amino-3-methyl-N-ethyl-N-B-butoxyethylaniline

Also, these p-phenylenediamine derivatives may form salts such as sulfates, hydrochlorides, sulfites, p-toluenesulfonates, etc. The above compounds are described in U.S. Pat. Nos. 2,193,015, 2,552,241, 2,566,271, 2,592,364, 3,656,950, 3,698,525, etc. The concentration of the aromatic primary amine developing agent is about 0.1 g to about 20 g, preferably about 0.5 g to about 10 g, per liter of color developer.

The color developer for use in this invention can contain a hydroxylamine as is well known. The hydroxylamine can be used as the form of a free amine in a color developer but is generally used as the form of a water-soluble acid salt thereof. Examples of the water-soluble salt of the hydroxylamine are generally sulfates, oxalates, chlorides, phosphates, carbonates, acetates, etc. The hydroxylamine may be substituted or may not be substituted and also the nitrogen atom of the hydroxylamine may be substituted by an alkyl group.

The pH of the color developer for use in this invention is preferably about 9 to 12, more preferably about 9 to 11.0 and the color developer may further contain known additives for color developer. For example, sodium hydroxide, potassium hydroxide, sodium carbonate, potassium carbonate, sodium tertiary phosphate, potassium tertiary phosphate, potassium metaborate, borax, etc., are used solely or as combination thereof as an alkali agent or a pH buffer for the color developer. Furthermore, disodium hydrogenphosphate, dipotassium hydrogenphosphate, potassium dihydrogenphosphate, sodium dihydrogenphosphate, sodium hydrogencarbonate, potassium hydrogencarbonate, boric acid, an alkali nitrate, an alkali sulfate, etc., are used for purposes of giving buffer faculty to the color developer, facilitating the preparation of the color developer, increasing the ionic strength, etc.

Still further, the color developer for use in this invention can contain various chelating agents for preventing the precipitation of calcium and magnesium. Examples of the chelating agent are polyphosphates, aminopolycarboxylates, phosphonocarboxylates, aminopolyphosphates, 1-hydroxyalkylidene-1,1-diphosphonic acids, etc.

Furthermore, the color developer for use in this invention can contain, if necessary, an optional development accelerator, such as the various pyrimidium compounds and other cationic compounds described, for example, in U.S. Pat. Nos. 2,648,604, 3,171,247, Japanese Patent Publication No. 9503/69, cationic dyes such as phenosafranine, etc., natural salts such as thallium nitrate, potassium nitrate, etc., the polyethylene glycol and the derivatives thereof described in Japanese Patent Publication No. 9304/69, U.S. Pat. Nos. 2,533,990, 2,531,832, 2,950,970, 2,577,127, etc., nonionic compounds such as polythioethers, etc., and the thioether compounds described in U.S. Pat. No. 3,201,243, etc.

Also, the color developer may further contain sodium sulfite, potassium sulfite, potassium hydrogensulfite, sodium hydrogensulfite, etc., as a precursor.

Moreover, the color developer for use in this invention may, if necessary, contain an optional antifoggant. Examples of the antifoggant are alkali metal halides such as potassium bromide, sodium bromide, potassium iodide, etc., and organic antifoggants. Examples of the organic antifoggants are nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, hydroxyazaindolizine, etc.; mercapto-substituted heterocyclic compounds such as 1-phenyl-5-mercaptotetrazole, 2-mercaptobenzimidazole, 2-mercaptobenzothiazole, etc.; and mercapto-substituted aromatic compounds such as thiosalicylic acid, etc. In these compounds, nitrogen-containing heterocyclic compounds are particularly preferred. These antifoggants may exist in the color photographic materials and dissolved therefrom in processing solutions and may be accumulated in the color developer.

A bleach solution or a blix solution for use in this invention contains an iron complex salt as a bleaching agent. In iron complex salts, an aminopolycarboxylic acid iron complex salt is preferred. The addition amount thereof is 0.01 to 1.0 mol/liter, preferably 0.05 to 0.50 mol/liter.

A fix solution or a blix solution for use in this invention contains a thiosulfate or a rhodanate as fixing agent. In particular, the use of ammonium thiosulfate is preferred. The fix solution or blix solution may generally contain a sulfite as a precursor but may contain ascorbic acid, a carbonyl hydrogensulfite addition product, or a carbonyl compound. Furthermore, the solution may, if necessary, contain a buffer, a brightening agent, a chelating agent, an antimold, etc.

The following examples are intended to illustrate this invention m o r e practically but not to limit in any way.

EXAMPLE 1

Multilayer silver halide color photographic materials (Samples 1 to 11) were prepared each by coating the following first layer (the lowermost layer) to seventh layer (the uppermost layer) on a paper support laminated with polyethylene at both surfaces thereof.

Support:

Polyethylene-laminated paper (containing a white pigment (e.g., $TiO_2$, etc.) and a blue dye (e.g., ultramarine blue, etc.) in the polyethylene layer at the emulsion layer side.

| | |
|---|---|
| **First Layer: Blue-Sensitive Emulsion Layer** | |
| Silver chlorobromide emulsion (silver bromide: 80 mol %) | 0.35 g/m$^2$ (as silver) |
| Gelatin | 1.54 g/m$^2$ |
| Yellow coupler*6 | 0.50 g/m$^2$ |
| Coupler solvent*2 | 0.50 g/m$^2$ |
| **Second Layer: Intermediate Layer** | |
| Gelatin | 1.10 g/m$^2$ |
| Color mixing preventing agent*4 | 0.20 g/m$^2$ |
| Color mixing preventing agent solvent*2 | 0.10 g/m$^2$ |
| **Third Layer: Green-Sensitive Emulsion Layer** | |
| Silver chlorobromide emulsion (silver bromide: 70 mol %) | 0.17 g/m$^2$ (as silver) |
| Gelatin | 1.40 g/m$^2$ |
| Magenta coupler (Table 1) | 0.40 g/m$^2$ |
| Coupler solvent*5 | 0.20 g/m$^2$ |
| **Fourth Layer: Ultraviolet Absorbing Layer** | |
| Gelatin | 1.60 g/m$^2$ |
| Ultraviolet absorbent*1 | 0.70 g/m$^2$ |

-continued

| | |
|---|---|
| Color mixing preventing agent*4 | 0.20 g/m$^2$ |
| Color mixing preventing agent solvent*2 | 0.30 g/m$^2$ |
| **Fifth Layer Red-Sensitive Emulsion Layer** | |
| Silver chlorobromide emulsion (silver bromide: 50 mol %) | 0.25 g/m$^2$ (as silver) |
| Gelatin | 1.26 g/m$^2$ |
| Cyan coupler*3 | 0.50 g/m$^2$ |
| Coupler solvent*2 | 0.25 g/m$^2$ |
| **Sixth Layer Ultraviolet Absorbing Layer** | |
| Gelatin | 1.06 g/m$^2$ |
| Ultraviolet absorbent*1 | 0.35 g/m$^2$ |
| Ultraviolet absorbent solvent*2 | 0.12 g/m$^2$ |
| **Seventh Layer: Protective Layer** | |
| Gelatin | 1.62 g/m$^2$ |

The compounds used for making the above-described samples were as follows.

*1 2-(2-Hydroxy-3-sec-butyl-5-t-butylphenyl)benzotriazole

*2 Dibutyl phthalate

*3 2[α-(2,4-Di-t-amylphenoxy)butanamido]-4,6-dichloro-5-methylphenol

*4 2,5-Di-t-octylhydroquinone

*5 Trioctyl phosphate

*6 α-Pivaloyl-α-(2,4-dioxo-5,5-dimethyloxazolidine-3-yl)-2-chloro-5-α-(2,4-di-t-amylphenoxy)-butanamido]acetanilide In addition, for each layer was used 1-oxy-3,5-dichloro-s-triazine sodium salt as a gelatin hardening agent.

Each of the samples thus prepared was exposed through an optical wedge and processed by the following steps.

| Processing Step | Temperature (°C.) | Time |
|---|---|---|
| Color Development | 33 | 3 min 30 sec |
| Blix | 33 | 1 min 30 sec |
| Wash | 24–34 | 3 min |

The compositions of the processing solutions used for the above steps were as follows:

| | |
|---|---|
| **Color Developer:** | |
| Water | 800 ml |
| Brightening Agent | 1.0 g |
| Sodium Tetrapolyphosphate | 2.0 g |
| Benzyl Alcohol | 14.0 ml |
| Diethylene Glycol | 10.0 ml |
| Sodium Sulfite | 2.0 g |
| Potassium Bromide | 0.5 g |
| Sodium Carbonate | 30.0 g |
| N-Ethyl-N-(β-methanesulfonamido)-ethyl-3-methyl-4-aminoaniline Sulfonate | 5.0 g |
| Hydroxylamine Sulfate | 4.0 g |
| Water to make | 1,000 ml |
| | pH: 10.00 (25° C.) |
| **Blix Solution:** | |
| Water | 400 ml |
| Ammonium Thiosulfate (70% solution) | 150 ml |
| Sodium Sulfite | 18 g |
| Ammonium Ethylenediaminetetraacetato Ferrate | 55 g |
| Disodium Ethylenediaminetetraacetate | 5 g |
| Water to make | 1,000 ml |
| | pH: 6.70 (25° C.) |

Each of Samples 1 to 11 was, after washing, split into five equal portions, each portion was immersed in one of the following five kinds of Washing Solutions A to E for 1 minute at 33° C., and after drying, the density thereof was measured. Thereafter, the samples were allowed to stand for 30 days under the conditions of 60° C. and 70% in relative humidity and the change of the photographic property (the minimum density ($D_B$min) of yellow density) thus obtained is shown in Table 1 below together with the change ($D^M$2.0) of the magenta density D=2.0 after irradiating the samples with xenon light (80,000 lux) for 14 days.

A: Water only (pH 7.0)

B: EDTAFe(III)$NH_4$·2$H_2O$:$1\times10^{-5}$ mol/l (pH 7.0)

C: EDTAFe(III)$NH_4$·2$H_2O$:$5\times10^{-4}$ mol/l (pH 7.0)

D: EDTAFe(III)$NH_4$·2$H_2O$:$1\times10^{-3}$ mol/l (pH 7.0)

E: EDTAFe(III)$NH_4$·2$H_2O$:$1\times10^{-3}$ mol/l and 1-hydroxyethylidene-1,1-diphosphate: $2\times10^{-3}$ mol/l (pH adjusted to 7.0 with aqueous $NH_3$)

Washing Solutions A and B are for comparative examples and Washing Solutions C to E are for examples of this invention.

TABLE 1

| Sample No. | Magenta Coupler | Final Bath A Comparison $\Delta D_B$min | A Comparison $\Delta D^M$2.0 | B Comparison $\Delta D_B$min | B Comparison $\Delta D^M$2.0 | C Invention $\Delta D_B$min | C Invention $\Delta D^M$2.0 | D Invention $\Delta D_B$min | D Invention $\Delta D^M$2.0 | E Invention $\Delta D_B$min | E Invention $\Delta D^M$2.0 |
|---|---|---|---|---|---|---|---|---|---|---|---|
| 1 | (a) (Comparison) | +0.24 | −0.25 | +0.29 | −0.23 | +0.32 | −0.21 | +0.38 | −0.20 | +0.33 | −0.23 |
| 2 | (b) (Comparison) | +0.20 | −0.25 | +0.25 | −0.22 | +0.30 | −0.20 | +0.36 | −0.23 | +0.32 | −0.24 |
| 3 | (c) (Comparison) | +0.25 | −0.24 | +0.30 | −0.22 | +0.33 | −0.22 | +0.39 | −0.22 | +0.33 | −0.23 |
| 4 | (d) (Comparison) | +0.23 | −0.24 | +0.29 | −0.23 | +0.34 | −0.22 | +0.40 | −0.21 | +0.34 | −0.24 |
| 5 | (e) (Comparison) | +0.23 | −0.25 | +0.28 | −0.23 | +0.33 | −0.24 | +0.39 | −0.23 | +0.34 | −0.24 |
| 6 | (f) (Comparison) | +0.30 | −0.25 | +0.34 | −0.23 | +0.36 | −0.25 | +0.41 | −0.23 | +0.37 | −0.24 |
| 7 | M-8 (Invention) | +0.08 | −0.24 | +0.08 | −0.23 | +0.09 | −0.11 | +0.09 | −0.09 | +0.08 | −0.11 |
| 8 | M-10 (Invention) | +0.06 | −0.21 | +0.06 | −0.22 | +0.07 | −0.09 | +0.07 | −0.09 | +0.06 | −0.10 |
| 9 | M-17 (Invention) | +0.08 | −0.25 | +0.08 | −0.23 | +0.09 | −0.12 | +0.09 | −0.11 | +0.08 | −0.11 |
| 10 | M-20 (Invention) | +0.06 | −0.23 | +0.06 | −0.21 | +0.06 | −0.10 | +0.06 | −0.09 | +0.06 | −0.10 |
| 11 | M-23 (Invention) | +0.06 | −0.22 | +0.06 | −0.21 | +0.07 | −0.10 | +0.07 | −0.10 | +0.06 | −0.11 |

As is clear from the results shown in Table 1, it can be seen that by processing the silver halide photographic materials each containing the magenta coupler defined in this invention using the final bath defined in this invention, the formation of yellow stain is greatly prevented and the occurrence of light fading of magenta is less.

Comparative Magenta Couplers (a) to (f) shown in Table 1 above are as follows:

Magenta Coupler (a)

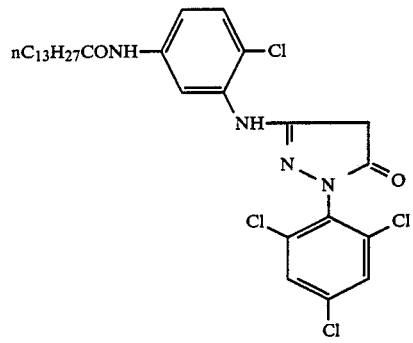

Magenta Coupler (b)

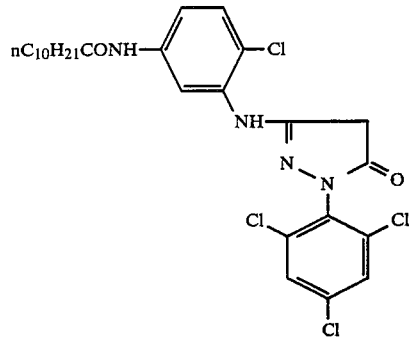

Magenta Coupler (c)

-continued
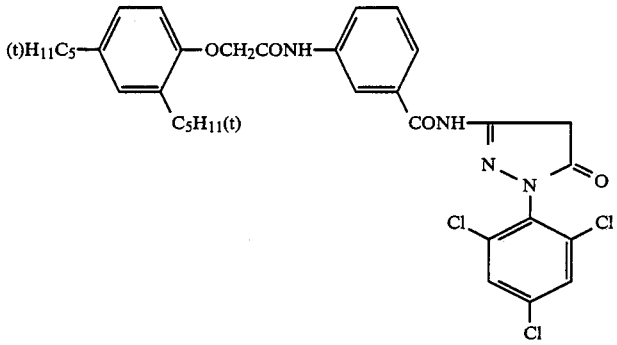
Magenta Coupler (d)
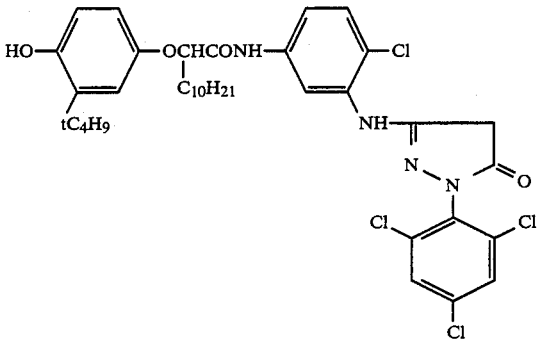
Magenta Coupler (e)
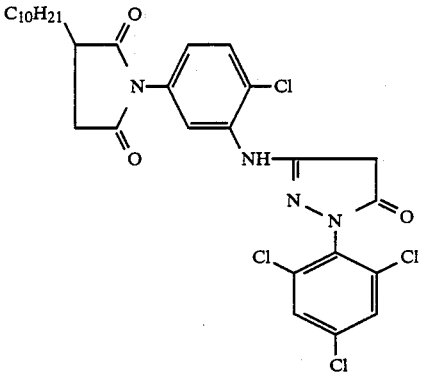
Magenta Coupler (f)
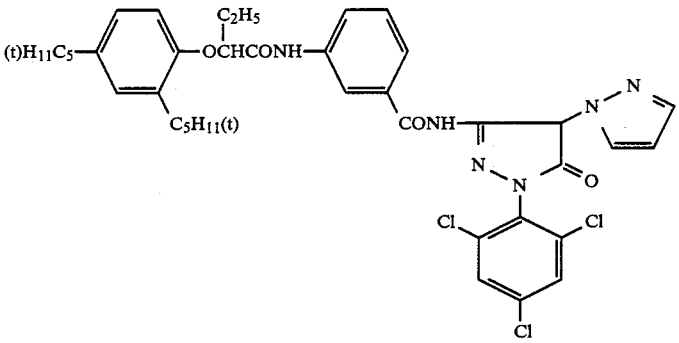
In addition, in the case of using the above-described Magenta Couplers (a) to (f), the green-sensitive emulsion layer containing the magenta coupler was coated at a silver amount of 0.34 $g/m^2$ in each case.

EXAMPLE 2

Samples 12 to 17 were prepared by following the same procedures as in Example 1 except that the cyan coupler shown below and the magenta coupler shown in Table 2 below were used in each sample.

Cyan Coupler:

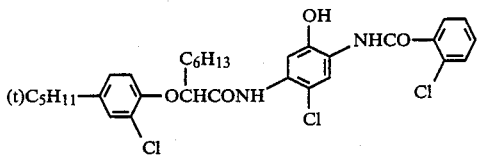

TABLE 2

| Magenta Coupler | |
|---|---|
| (a) | 0.50 g/m$^2$ |
| (b) | 0.40 g/m$^2$ |
| (c) | 0.40 g/m$^2$ |
| M-10 | 0.40 g/m$^2$ |
| M-17 | 0.40 g/m$^2$ |
| M-23 | 0.40 g/m$^2$ |

Each of Samples 12 to 17 was imagewise exposed and then continuously processed by the following processing steps using Fuji Color Roll Processor FPRO 115 (trade name, made by Fuji Photo Film Co., Ltd.).

| | Time | Temperature | Tank Capacity |
|---|---|---|---|
| Color Development | 3.30 min | 38° C. ± 0.3° C. | 60 liters |
| Blix | 1.30 min | 33° C. ± 1° C. | 40 liters |
| Wash (1) | 1.00 min | 33° C. ± 3° C. | 20 liters |
| Wash (2) | 1.00 min | 33° C. ± 3° C. | 20 liters |
| Wash (3) | 1.00 min | 33° C. ± 3° C. | 20 liters |

In addition, the wash step employed in the example was a three-stage countercurrent wash step from Wash (3) to Wash (1).

Also, the carrying amount of the processing solution in each bath from the blix step to Wash (3) was 60 ml/m$^2$.

The conditions for the color development step were constant for each sample, the amount of the supplement solution shown below was 161 ml per square meter of the light-sensitive material (sample), and the compositions of the processing solutions (tank solution and supplement solution) used in the example were as follows.

| Color Developer | Tank Solution | Supplement Solution |
|---|---|---|
| Water | 800 ml | 800 ml |
| Brightening Agent | 1.0 g | 1.5 g |
| Nitrilotriacetic Acid.3Na | 2.0 ml | 2.0 ml |
| Benzyl Alcohol | 14 ml | 18 ml |
| Diethylene Glycol | 10 ml | 10 ml |
| Sodium Sulfite | 2.0 g | 2.5 g |
| Hydroxylamine Sulfate | 3.0 g | 3.5 g |
| Potassium Bromide | 1.0 g | — |
| Sodium Carbonate | 30 g | 35 g |
| N-Ethyl-N-(β-methanesulfonamidoethyl)-3-methyl-4-aminoaniline Sulfate | 5.0 g | 8.0 g |
| Water to make | 1,000 ml | 1,000 ml |

-continued

| Color Developer | Tank Solution | Supplement Solution |
|---|---|---|
| pH | 10.15 | 10.65 |

Also, the conditions for the blix step were constant for each sample, the amount of the supplement solution was 60 ml per square meter of the light-sensitive material, and the compositions of the processing solutions were as follows.

| Blix Solution | Tank Solution | Supplement Solution |
|---|---|---|
| Water | 400 ml | 400 ml |
| Ammonium Thilsulfate (70% soln.) | 150 ml | 300 ml |
| Sodium Sulfite | 18 g | 36 g |
| Ammonium Ethylenediaminetetra-acetato Ferrate | 55 g | 110 g |
| Disodium Ethylenediaminetetra-acetate | 5 g | 10 g |
| Water to make | 1,000 ml | 1,000 ml |
| pH | 6.70 | 6.50 |

The wash step was performed for each sample in the following four conditions.

Condition F:

Water only was supplemented in an amount of 10 liters per square meter of each sample.

Condition G:

Water only was supplemented in an amount of 1,000 ml per square meter of each sample.

Condition H:

Water only was supplemented in an amount of 250 ml per square meter of each sample.

Condition I:

The supplement solution having the following composition was supplemented in an amount of 250 ml per square meter of each sample.

| Supplement Wash Solution | |
|---|---|
| 1-Hydroxyethylidene-1,1-diphosphonic Acid (60% solution) | 2.0 ml |
| Bismuth Chloride | 1.0 g |
| 5-Chloro-2-methyl-4-isothiazolin-3-one | 50 mg |
| 2-Octyl-4-isothiazolin-3-one | 30 mg |
| Water to make | 1 liter |
| pH adjusted to 7.0 with an aqueous ammonia | |

Each sample was processed at 400 m$^2$ for each condition.

Thus, the wedge-exposed sample was processed and the density was measured for each sample thus processed. Thereafter, the change of yellow stain in the case of allowing to stand each sample for 60 days under the conditions of 60° C. and 70% in relative humidity and the change of the density of magenta at D=2.0 in the case of irradiating the sample with xenon light (80,000 lux) for 14 days were measured and the results obtained are shown in Table 2 below.

Also, the iron concentration of each final bath in this case was analyzed by an atomic absorption method.

As shown in Table 3 below, it can be seen that according to the invention the increase of yellow stain and the light fading of magenta color are greatly prevented by the effect of an iron salt which is carried in the final bath from the prebath.

TABLE 3

| | Processing Step | | | | | | | |
|---|---|---|---|---|---|---|---|---|
| | F* | | G* | | H** | | I** | |
| | Iron Concentration | | | | | | | |
| | $(1.3-1.5) \times 10^{-7}$M | | $(1.5-1.6) \times 10^{-5}$M | | $(6.0-6.5) \times 10^{-3}$M | | $(6.0-6.5) \times 10^{-3}$M | |
| | Density | | | | | | | |
| Sample No. | $\Delta D_{B}min$ | $\Delta D^{M}2.0$ | $\Delta D_{B}min$ | $\Delta D^{M}2.0$ | $\Delta D_{B}min$ | $\Delta D^{M}2.0$ | $\Delta D_{B}min$ | $\Delta D^{M}2.0$ |
| 12 (Comparison) | +0.36 | −0.35 | +0.43 | −0.34 | +0.49 | −0.34 | +0.44 | −0.33 |
| 13 (Comparison) | +0.35 | −0.32 | +0.40 | −0.31 | +0.47 | −0.30 | +0.40 | −0.29 |
| 14 (Comparison) | +0.40 | −0.24 | +0.42 | −0.24 | +0.44 | −0.23 | +0.46 | −0.22 |
| 15 (Invention) | +0.17 | −0.27 | +0.17 | −0.27 | +0.18 | −0.09 | +0.17 | −0.10 |
| 16 (Invention) | +0.19 | −0.28 | +0.20 | −0.26 | +0.19 | −0.10 | +0.18 | −0.11 |
| 17 (Invention) | +0.20 | −0.26 | +0.20 | −0.24 | +0.20 | −0.13 | +0.20 | −0.12 |

*Comparison
**Invention

As described above, according to this invention, color images having almost no formation of dark yellow stains and greatly improved light fastness of magenta color can be obtained and also the amount of water in the photographic processing can be saved.

While the invention has been described in detail and with reference to specific embodiments thereof, it will be apparent to one skilled in the art that various changes and modifications can be made therein without departing from the spirit and scope thereof.

What is claimed is:

1. A process for processing a silver halide color photographic material which comprises subjecting an imagewise exposed silver halide color photographic material comprising a support having provided thereon at least one photographic emulsion layer containing at least one kind of pyrazoloazole series magenta coupler represented by general formula (I) to photographic processing comprising a color developing, bleaching and fixing or bleach-fixing and then using a bath containing at least $1\times10^{-4}$ mol/liter of a soluble iron salt substantially in the form of a complex with a chelating agent as the final bath:

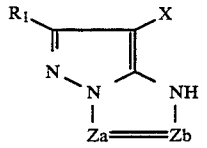

(I)

wherein Za and Zb each represents =CH—,

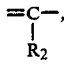

or =N—, wherein $R_2$ represents a hydrogen atom or substituent; $R_1$ represents a hydrogen atom or a substituent; X represents a hydrogen atom or a group releasable upon coupling with the oxidation product of an aromatic primary amine developing agent; when Za=Zb is a carbon-carbon double bond, the double bond may be a part of an aromatic ring; said magenta coupler may form a dimer or polymer at $R_1$, $R_2$ or X; when at lest one of said Za and Zb is

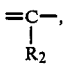

at least one of said $R_1$ and $R_2$ represents a methylene group directly bonded to the skeleton of general formula (I), at least one of the hydrogen atoms being replaced by a substituent other than hydrogen; when both Za and Zb are =N—, $R_1$ is a methylene group directly bonded to the skeleton, at least one of the hydrogen atoms being replaced by a substituent other than hydrogen; and said $R_1$ or $R_2$ has at least one —$NHSO_2$— as a substituent.

2. A process of claim 1, wherein said dimer or polymer means the cases in which two or more moieties having general formula (I) occur in one molecule, and which includes a bis compound and a polymer coupler.

3. A process of claim 2, wherein at least one of said methylene group directly bonded to the skeleton is substituted by an alkyl group.

4. A process of claim 2, wherein said polymer coupler may be a homopolymer of monomer units having the moiety shown by general formula (I) or may be a copolymer containing non-coloring ethylenic monomer units which does not cause a coupling reaction with the oxidation product of an aromatic primary amine developing agent.

5. A process of claim 4, wherein at least one of said methylene group directly bonded to the skeleton is substituted by an alkyl group.

6. A process of claim 1, wherein said pyrazoloazole series magenta coupler is represented by general formulae (I-1), (I-2), (I-3), (I-4) and (I-5):

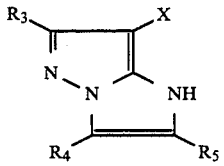

(I-1)

-continued (I-2)

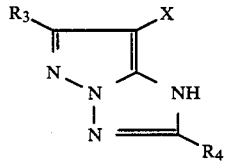

(I-3)

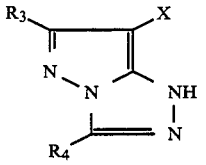

(I-4)

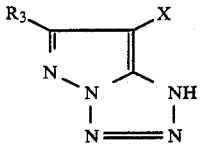

(I-5)

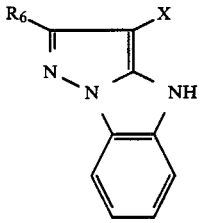

wherein $R_3$, $R_4$ and $R_5$ each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylaminc group, a sulfonamido group, a carbamoyl group, an acyl group, a sulfamoyl group, a sulfonyl group, a sulfinyl group, an alkoxycarbonyl group or an aryloxycarbonyl group; at least one of said $R_3$, $R_4$ and $R_5$ represents a branched alkyl group at the position directly bonded to the skeleton; and $R_6$ represents a branched alkyl group at the position directly bonded to the skeleton; X represents a hydrogen atom, a halogen atom, a carboxy group or a coupling-off group attached to the carbon atom in the coupling position through an oxygen atom, a nitrogen atom or a sulfur atom.

7. A process of claim 6, wherein said $R_3$, $R_4$, $R_5$, $R_6$ or X may be a divalent group to form a bis compound; and when the moiety shown by general formulae (I-1) to (I-5) is in the vinyl monomer, said $R_3$, $R_4$, $R_5$, or $R_6$ represents a simple bond or a linkage group, through which the moiety shown by general formulae (I-1) to (I-5) is bonded to a vinyl group.

8. A process of claim 6, wherein said pyrazoloazole series magenta coupler is represented by general formulae (I-1), (I-2) and (I-3).

9. A process of claim 6, wherein said pyrazoloazole series magenta coupler is represented by general formula (I-2).

10. A process of claim 1, wherein said pyrazoloazole series magenta coupler represented by general formula (I) is incorporated in a hydrophilic organic colloid for forming a photographic light-sensitive layer together with a high boiling organic solvent as a dispersion therein.

11. A process of claim 1, wherein the ratio of said magenta coupler represented by general formula (I) to the silver halide in the magenta coloring silver halide emulsion layer is 0.05 to 5 mol.

12. A process of claim 1, wherein the ratio of a high boiling organic solvent to said magenta coupler represented by general formula (I) is 0 to 6.0.

13. A process of claim 1, wherein the chelating agent which forms the soluble iron salt is a compound having at least two atoms or groups selected from a nitrogen atom, a carboxylic group, a phosphoric acid group and a hydroxyl group which can coordinate.

14. A process of claim 1, wherein said soluble iron salt is contained in an amount of $1\times10^{-4}$ to $1\times10^{-1}$ mol per liter of the final bath.

15. A process of claim 1, wherein said soluble iron salt is contained in an amount of $1.5\times10^{-4}$ to $1\times10^{-2}$ mol per liter of the final bath.

16. A process of claim 1, wherein the pH of said final bath is 3 to 9.

17. A process of claim 1, wherein the temperature of said final bath is 5° to 40° C.

18. A process of claim 1, wherein the temperature of said final bath is 10° to 35° C.

19. A process of claim 1, wherein said substituent —$NHSO_2$— is directly bonded to an alkylene group directly bonded to the pyrazoloazole skeleton.

* * * * *